US005687967A

United States Patent [19]

Klaus

[11] Patent Number: 5,687,967

[45] Date of Patent: Nov. 18, 1997

[54] ROULETTE EQUIPMENT

[75] Inventor: Willi Klaus, Dortmund, Germany

[73] Assignee: Anette Klaus, Dortmund, Germany

[21] Appl. No.: 535,768

[22] Filed: Sep. 28, 1995

[30] Foreign Application Priority Data

Sep. 29, 1994 [DE] Germany ..... 44 34 817.7

[51] Int. Cl.[6] ..... A63F 5/02

[52] U.S. Cl. ..... 273/142 E; 273/142 R

[58] Field of Search ..... 273/138 R, 139, 273/142 R, 143 R, 143 A, 143 E, 142 D, 142 E, 142 A, 142 H, 142 HA, 142 J, 142 JD, 142 JA, 142 JB, 142 JC, 142 K

[56] References Cited

U.S. PATENT DOCUMENTS

| | | | |
|---|---|---|---|
| 1,370,682 | 3/1921 | Buys | 273/142 R |
| 1,578,412 | 3/1926 | Ewig | 273/142 E |
| 3,441,281 | 4/1969 | Pannwitz | 273/142 R |
| 3,853,324 | 12/1974 | Reiner et al. | 273/142 E |
| 5,102,135 | 4/1992 | Addiechi | 273/142 E |
| 5,118,110 | 6/1992 | Jones | 273/142 R X |
| 5,437,452 | 8/1995 | Graf et al. | 273/142 E |

FOREIGN PATENT DOCUMENTS

| | | | |
|---|---|---|---|
| 148577 | 2/1937 | Germany | 273/142 R |
| 3531375 | 3/1987 | Germany | 273/142 HA |
| 3702880 | 8/1988 | Germany | 273/142 E |
| 503353 | 4/1939 | United Kingdom | 273/142 R |

*Primary Examiner*—William E. Stoll
*Attorney, Agent, or Firm*—Max Fogiel

[57] ABSTRACT

To make it more difficult for system gamblers to predict their chances of successfully placing their chips, the number ring in roulette equipment is an independent component that rests on the bottom of the bowl and can be angularly displaced from outside against inherent resistance. The ring is re-adjusted from time to time by the casino personnel to contaminate the probabilities.

17 Claims, 1 Drawing Sheet

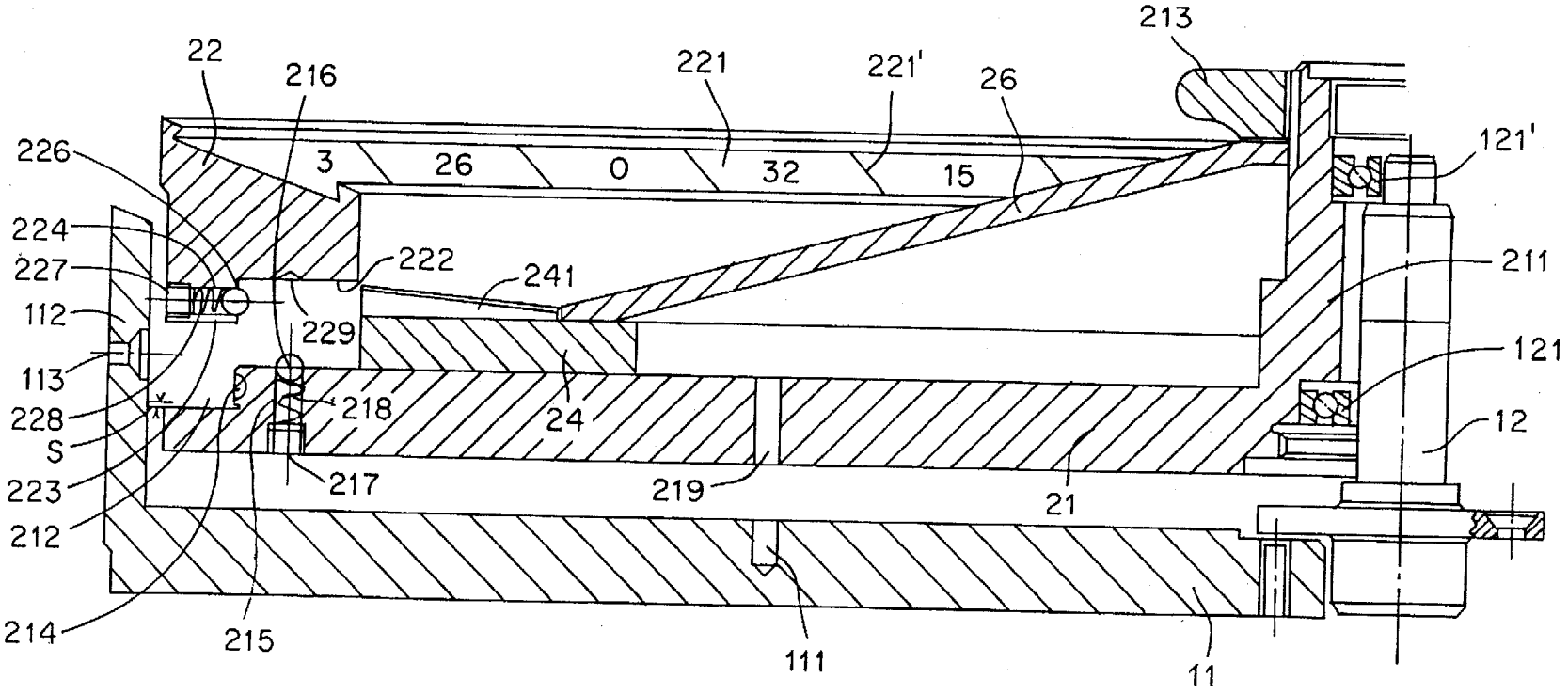
121'
211
121
12
213
11
21
26
15
221'
32
221
0
26
3
22
111
219
24
241
222
229
218
217
216
215
226
224
227
112
113
228
S
223
212
214

ROULETTE EQUIPMENT

BACKGROUND OF THE INVENTION

The present invention concerns roulette equipment. The equipment comprises a base, a stationary shaft, and a bowl. The shaft extends up out of the base, and the bowl rotates on it. The interior of the bowl is divided into two rings and a center. The first ring, adjacent to the edge, is divided into fields marked with numbers. The second ring is positioned somewhat lower just inside the first ring and separated by radial frets into "canoes", compartments that intercept the ball. Each canoe is as wide as and is associated with one of the fields. The center of the bowl is concealed by a shallow conical "pan". Equipment of this genus is known from Austrian Patent 396 069 B.

There are usually 37 number fields in a roulette bowl. The bowl spins in one direction and the ball rolls around it in the opposite direction. A win in roulette is indicated by the number and/or color of the field associated with the canoe that the ball eventually rolls into. Given constant conditions of play and enough time, each canoe has the same probability of leading to a win. When accordingly a particular canoe has not been played for some time, the probability that it subsequently will, continues to increase. Professional gamblers exploit this situation by observing the play for a long time, sometimes for days and even weeks, keeping track of what field or fields are played only seldom if at all. Such gamblers will then incur less risk by even repeatedly playing the numbers neglected in the past. German GM 1 998 918 discloses a roulette-like game with a rotor that compares to the bowl in roulette. Associated with the rotor is a replaceable ring that accommodates both the numbers and the canoes. The rotor can accordingly be provided with different graduations. It is, however, impossible to vary the association between the canoes and the fields in the number ring.

SUMMARY OF THE INVENTION

With the aforesaid prior art as a point of departure, the object of the present invention is to limit the ability of professional gamblers to estimate their chances of winning.

This object is attained in accordance with the present invention in generic roulette equipment in that the number ring is an independent component that rests on the bottom of the bowl and can be angularly displaced from outside against inherent resistance.

The number ring in the roulette equipment in accordance with the present invention can be angularly displaced one or more fields around the interior of the bowl after being used for a while, at the end of a day of play for example, changing the association between the numbers and the canoes. This will prevent professional gamblers from predicting future strikes with respect to the numbers and more concretely to the canoes from long observation of the play.

The number ring can be permanently fastened to the bottom of the bowl. This approach does not exclude attaching the ring to the bottom such that it can be detached therefrom. This can be done by closing off the bores that extend through the ring and accommodate the balls that attach it to the bottom. This approach will allow the race on the lower surface of the ring and facing the bottom of the bowl to be cleaned when necessary.

The present invention is not limited in the details of its design to the characteristics recited in the accompanying claims, especially in relation to how the number ring can be attached to and detached from the bottom of the bowl or even to how that ring is positioned relative to the bottom.

The present invention will now be specified with reference to the accompanying drawing. The sole figure is a section through part of the equipment illustrating the details of the present invention.

BRIEF DESCRIPTION OF THE DRAWINGS

A sectional view showing the essential elements of the roulette arrangement, according to the present invention.

DESCRIPTION OF THE PREFERRED EMBODIMENTS

A bowl rotates around a shaft 12 that extends up from a base 11. The bowl rests vertically and radially against ball bearings 121 and 121'. The bowl is in two parts in accordance with the present invention and comprises a bottom 21 and a ring 22. The bowl rests on bottom 21 by way of a hub 211. Ring 22 is provided with numbers 221 and rests on the outer edge of bottom 21. Bottom 21 incorporates an inner ring 24 surrounded by number ring 22 and accommodating the canoes 241 that intercept the ball. Canoe ring 24 surrounds the center of the bowl. A pan 26 that conceals the center rests on canoe ring 24. Hub 211 extends up out of bottom 21 and through pan 26. Pan 26 is secured to bottom 21 by a nut 213 that screws down against pan 26 on hub 211.

A rim 223 around the lower surface 222 of number ring 22 fits against a matching recess 212 in the bottom 21 of the bowl, leaving a slight gap s. Gap s is left over, once number ring 22 has been attached to bottom 21, in the form of a groove 214 that extends around the inner surface of recess 212. Radial bores 224 extend through the rim 223 around the lower surface of number ring 22. Bores 224 accommodate balls 224. Balls 224 are forced into groove 214 by springs 228, maintaining number ring 22 fastened to bottom 21. Springs 228 can be adjusted by means of plugs 227.

Accommodations 229 are distributed at equal intervals along a circle on the lower surface 222 of the number ring 22. Each accommodation 229 is aligned with one of the divisions 221' between the number fields. There are preferably as many accommodations 229 as divisions 221'. There is a matching circle of bores 215 that extend through the bottom 21 of the bowl. Each bore 215 accommodates a ball 216. Balls 216 are subject to springs 218 that force them into accommodations 229. Springs 218 are maintained in position by plugs 217 in bores 215. Number ring 22 is accordingly secured by tension in relation to the bottom 21 of the bowl subsequent to each turn in the direction indicated by double-headed arrow A with the fields accommodating numbers 221 definitely oriented in relation to the canoes 241 in the bottom of the bowl and especially on the ring that rests thereon. There is a bore 219 extending through the bottom 21 of the bowl under pan 26. There is a corresponding circle of several bores 111 extending part-way through base 11.

The present invention is intended to allow angular displacement in the direction indicated by double-headed arrow A of number ring 22 around the bottom 21 of the bowl with canoe ring 24 resting on it. How this is accomplished will now be described. Nut 213 is loosened and pan 26 removed. A bolt is inserted through one of the bores 219 in bottom 21 and into the bore or into one of the bores 111 in base 11, securing bottom 21 in relation to base 11. Number ring 22 can now be angularly displaced around bottom 21 in the direction indicated by double-headed arrow A against the inherent resistance deriving from the force exerted on balls 224 by the springs in accommodations 229, altering the association between numbers 221 and canoes 241. The bolt securing the bottom 21 of the bowl to base 11 is now extracted and pan 26 replaced and secured to the bottom by means of nut 213. The roulette equipment is now ready for use, but with the association between numbers and canoes altered.

The bowl, and accordingly its bottom 21, and number ring 22 are entirely surrounded by an elevated edge 112 around base 11. Elevated edge 112 accommodates at least one port 113 that provides access to the bores 224 extending through the rim 223 around the bottom of number ring 22 and in particular to plugs 227 in the form of headless screws when the ring is correctly oriented in relation to ports 113.

I claim:

1. A roulette arrangement comprising: a base and a stationary shaft extending up out of said base; a bowl rotating on said shaft, said bowl having an interior divided into first and second rings and a center, said first ring being adjacent to an edge of said bowl and being divided into fields marked with numbers, said second ring being positioned lower inside said first ring and separated by radial frets into canoes, each of said canoes being as wide as an associated one of said fields; a shallow conical pan concealing said center; said first ring being an independent component of components of said bowl and resting on a bottom of said bowl and being angularly displaceable from outside of said roulette arrangement against inherent resistance; a rim around a lower surface of said first ring and fitting into a matching recess in said bottom of said bowl and leaving a gap at a level of said recess in the form of a groove extending around an inner surface of said recess, radial bores extend through said rim; balls accommodated by said bores and forced into said groove by springs; and plugs for maintaining said balls in said bores.

2. A roulette arrangement as defined in claim 1, wherein said springs are helical springs.

3. A roulette arrangement as defined in claim 1, wherein said plugs are headless screws that screw into said bores.

4. A roulette arrangement comprising: a base and a stationary shaft extending up out of said base; a bowl rotating on said shaft, said bowl having an interior divided into first and second rings and a center, said first ring being adjacent to an edge of said bowl and being divided into fields marked with numbers, said second ring being positioned lower inside said first ring and separated by radial frets into canoes, each of said canoes being as wide as an associated one of said fields; a shallow conical pan concealing said center; said first ring being an independent component of components of said bowl and resting on a bottom of said bowl and being angularly displaceable from outside of said roulette arrangement against inherent resistance; said first ring being independently movable of other parts of said bowl for limiting the ability of players to estimate their chances of winning by being angularly displaceable through at least one field around the interior of said bowl after having been operative for a time to change an association between said numbers and said canoes.

5. A roulette arrangement as defined in claim 4, including matching catches spaced at regular intervals along said bottom of said bowl and along said first ring for defining a correct orientation of said numbers in relation to said canoes.

6. A roulette arrangement as defined in claim 5, wherein said catches in said first ring are aligned with lateral demarcations between said fields, said catches being associated with said bottom of said bowl and being aligned with later demarcations between said canoes.

7. A roulette arrangement as defined in claim 5, wherein said catches are as far apart as a width of one number field.

8. A roulette arrangement as defined in claim 5, wherein said catches are as far apart as a total width of more than one number field.

9. A roulette arrangement as defined in claim 5, wherein said catches are in form of setbacks in a lower surface of said first ring; additional balls, each of said balls being accommodated in a bore extending toward said setbacks through said bottom of said bowl; a plug for plugging said bore at an end opposite the ball; and a spring accommodated in said bore between the ball and said plug and resting against said plug and forcing said ball into said setbacks.

10. A roulette arrangement as defined in claim 9, wherein said spring is a helical spring.

11. A roulette arrangement as defined in claim 9, wherein said plugs are headless screws that screw into the bores.

12. A roulette arrangement as defined in claim 9, wherein said first ring is mounted with play between said first ring and said bottom of said bowl demarcated by said additional balls, said additional balls being resiliently mounted and entering part way accommodations on said first ring when a groove in a wall of said recess in said bottom of said bowl is at a right level.

13. A roulette arrangement as defined in claim 12, wherein said play is substantially 1.5 mm.

14. A roulette arrangement as defined in claim 5, wherein said catches distributed around the bottom of the bowl are unequal in number to said ring.

15. A roulette arrangement as defined in claim 4, including a brake mounted on said bottom of said bowl for braking said bowl.

16. A roulette arrangement as defined in claim 15, including a bolt inserted through said bottom of said bowl and into said base.

17. A roulette arrangement as defined in claim 15, wherein said brake is below said pan.

* * * * *